US005164234A

United States Patent [19]

Siebert

[11] Patent Number: 5,164,234

[45] Date of Patent: Nov. 17, 1992

[54] TREATING AN AUTODEPOSITED COATING WITH AN ALKALINE SOLUTION CONTAINING ORGANOPHOSPHONATE IONS

[75] Inventor: Elizabeth J. Siebert, Troy, Mich.

[73] Assignee: Henkel Corporation, Ambler, Pa.

[21] Appl. No.: 645,435

[22] Filed: Jan. 24, 1991

[51] Int. Cl.[5] ..... B05D 1/36

[52] U.S. Cl. ..... 427/419.8; 427/435; 427/437; 427/443.1; 106/14.12; 106/14.14

[58] Field of Search ..... 427/435, 341, 419.7, 427/419.8, 437, 443.1; 106/14.12, 14.14

[56] References Cited

U.S. PATENT DOCUMENTS

| | | | |
|---|---|---|---|
| 3,592,699 | 7/1971 | Steinbrecher et al. | 148/6.2 |
| 3,617,368 | 11/1971 | Gibbs et al. | 428/336 |
| 3,647,567 | 3/1972 | Schweri | 148/6.15 |
| 3,709,743 | 1/1973 | Dalton et al. | 427/435 |
| 3,795,546 | 3/1974 | Hall et al. | 148/6.2 |
| 3,922,451 | 11/1975 | Anschutz et al. | 428/36.6 |
| 4,029,679 | 6/1977 | Kötzsch et al. | 427/409 |
| 4,030,945 | 6/1977 | Hall et al. | 428/462 |
| 4,048,374 | 9/1977 | Kötzsch et al. | 427/417 |
| 4,103,049 | 7/1978 | Nishida et al. | 427/341 |
| 4,191,676 | 3/1980 | Hall | 260/29.7 |
| 4,222,779 | 9/1980 | Bengali et al. | 106/14.12 |
| 4,225,350 | 9/1980 | Allan et al. | 106/14.12 |
| 4,347,172 | 8/1982 | Nishida et al. | 524/319 |
| 4,401,587 | 8/1983 | Boffardi | 106/14.12 |
| 4,411,937 | 10/1983 | Nishida et al. | 427/435 |
| 4,411,950 | 10/1983 | Smith | 428/327 |
| 4,433,015 | 2/1984 | Lindert | 427/388.4 |
| 4,437,898 | 3/1984 | Drosdziok et al. | 106/14.12 |
| 4,636,265 | 1/1987 | Fischer et al. | 427/435 |
| 4,637,839 | 1/1987 | Hall | 148/6.2 |
| 4,647,480 | 3/1987 | Ahmed | 427/341 |
| 4,731,146 | 3/1988 | Clark | 427/302 |
| 4,816,303 | 3/1989 | Kroenke et al. | 427/435 |
| 4,917,737 | 4/1990 | Carey et al. | 148/250 |
| 5,004,646 | 4/1991 | Benham et al. | 427/435 |
| 5,011,715 | 3/1991 | Broadbent | 427/443.1 |

FOREIGN PATENT DOCUMENTS 0312648 4/1989 European Pat. Off. .

*Primary Examiner*—Michael Lusignan
*Assistant Examiner*—Diana L. Dudash
*Attorney, Agent, or Firm*—Ernest G. Szoke; Wayne C. Jaeschke; Norvell E. Wisdom, Jr.

[57] ABSTRACT

The adhesion and/or corrosion resistance of a autodeposited coating can be improved by rinsing the uncured coating with an aqueous treatment solution that has a pH between 7 and 11 and contains between 0.05 and 5 w/o of anions derived from phosphonic acids, preferably anions of 1-hydroxyethylidene-1,1-diphosphonic acid. The method is particularly useful on leaf springs and other metallic objects with surfaces of high carbon and/or shot blasted steel, and is particularly useful in conjunction with an autodeposition bath containing internally stabilized poly (vinylidene chloride) latex, hydrofluoric acid, ferric fluoride, and hydrogen peroxide.

16 Claims, No Drawings

TREATING AN AUTODEPOSITED COATING WITH AN ALKALINE SOLUTION CONTAINING ORGANOPHOSPHONATE IONS

BACKGROUND OF THE INVENTION

1. Field of the Invention

This invention relates to autodeposition. Autodeposition involves the use of an aqueous resinous coating composition of relatively low solids concentration (usually less than about 10%) to form a coating of relatively high solids concentration (usually greater than about 10%) on a metallic surface immersed therein, with the coating increasing in thickness and areal density (mass per unit area of coating) the longer the time the metallic surface is immersed in the composition. Autodeposition is somewhat similar to electrodeposition but does not require the aid of external electrical current to cause the resin particles to deposit on the metal surface. In general, autodepositing compositions are aqueous acid solutions having solid resin particles dispersed therein in very finely divided form. The coating formed while the metal substrate used is immersed in the bath is generally wet and fairly weak, although sufficiently strong to maintain itself against gravity and moderate spraying forces. In this state the coating is described as "uncured". To make an autodeposition coated object suitable for normal practical use, the uncured coated is dried, usually with the aid of heat. The coating is then described as "cured".

The present invention relates more particularly to the chemical treatment of an uncured autodeposited coating for the purpose of improving various properties thereof, particularly the adhesion of the coating to the underlying metal substrate and the resistance to corrosion of the underlying metal provided by the cured autodeposited coating when the coated metal surfaced object is subjected to corrosive environments.

STATEMENT OF RELATED ART

Basic constituents of an autodepositing composition are water, resin solids dispersed in the aqueous medium of the composition, and activator, that is, an ingredient or ingredients which convert the composition into one which will form on a metallic surface a resinous coating which increases in thickness or areal density as long as the surface is immersed in the composition. Various types of activators or activating systems are known, for example, as reported in the following U.S. Pat. Nos.: 3,592,699; 3,709,743; 4,103,049; 4,347,172; and 4,373,050, the disclosures of which, to the extent not inconsistent with any explicit statement herein, are incorporated herein by reference. The activating system generally comprises an acidic oxidizing system, for example: hydrogen peroxide and HF; $HNO_3$; a ferric-containing compound and HF; and other soluble metal-containing compounds, for example, silver fluoride, ferrous oxide, cupric sulfate, cobaltous nitrate, silver acetate, ferrous phosphate, chromium fluoride, cadmium fluoride, stannous fluoride, lead dioxide, and silver nitrate in an amount between about 0.025 and about 50 grams per liter ("g/l") and an acid, which can be used alone or in combination with hydrofluoric acid, and including, for example, sulfuric, hydrochloric, nitric, and phosphoric acid, and organic acids, including, for example, acetic, chloroacetic, and trichloroacetic.

Previously known autodepositing compositions can be used to form coatings which have good aesthetic properties and which protect the underlying metallic substrate from being degraded (for example, corroded by water). However, there are certain applications which require that the autodeposited coating have particularly good properties for satisfactory use. Various means have been developed to improve the properties of autodeposited coatings, including, for example: chemical pretreatment of the metallic surface prior to formation of the coating; selection of particular resins for use in forming the coating; addition to the autodepositing composition of chemical additives; and chemical treatment of the freshly formed or uncured coating, as described in detail in copending Application Ser. No. 202,117 filed Jun. 3, 1988 and assigned to the same assignee as this application.

There are several U.S. patents which disclose the treatment of freshly formed autodeposited coatings with acidic aqueous solutions of one or more chromium compounds to improve the corrosion-resistance and/or surface appearance of the cured coating. Among such patents are U.S. Pat. Nos.: 3,795,546; 4,030,945; 4,411,950; and 4,637,839, all assigned to the same assignee as that of the present invention. The '546 and '945 patents disclose treating an uncured autodeposited coating with an acidic aqueous solution containing hexavalent chromium or hexavalent chromium and formaldehyde-reduced forms of hexavalent chromium to improve the corrosion-resistant properties of the cured form of the coating and to reduce the gloss of an otherwise glossy coating. According to these patents, the source of chromium can be chromium trioxide or water-soluble salts of chromium or dichromate, for example, sodium, potassium, and lithium salts thereof. Optional ingredients of such chromium-containing solutions include phosphoric acid (anti-gelling agent), sodium hydroxide (pH adjuster), and a water-soluble or water-dispersible polyacrylic acid (corrosion-resistant and paint-bonder improver). The '950 patent discloses the treatment of an uncured autodeposited coating with an aqueous chromium-containing solution which has dispersed therein particles of a resin which functions to impart to the cured form of the coating a reduced coefficient of friction. The patent discloses that the function of the chromium is to improve the corrosion-resistant properties of the cured coating, and the function of the resin, for example, polytetrafluoroethylene, is to increase the surface slip of the cured form of the coating. The '839 patent discloses the treatment of an uncured autodeposited coating with an acidic aqueous treating solution prepared by admixing a hexavalent chromium-containing compound (for example, ammonium and an alkali metal dichromate) with a hexavalent chromium/reduced chromium solution. In addition, the treating solution contains an acid or salt thereof, for example, hydrochloric acid, nitric acid, sulfuric acid, phosphoric acid, and ammonium, alkali metal, and alkaline earth metal salts of phosphoric acid. This patent discloses that the use of such a solution imparts a matte appearance to an autodeposited coating which otherwise would have a glossy appearance and improves the corrosion-resistant properties of the coating. In addition, U.S. Pat. No. 3,647,567 discloses the use of an acidic aqueous solution of chromium trioxide or of water-soluble or acid-soluble chromates and dichromates to improve the corrosion resistance of the resinous coatings described therein. Exemplary chromates and dichromates are sodium, ammonium, lithium, magnesium, potassium and zinc.

Japanese Patent No. 7630247 discloses the treatment of an uncured autodeposited coating with an aqueous solution or dispersion of a vulcanizing agent (for example, a sulfur-containing compound) or of a vulcanizing accelerator (for example, hexamethylenetetramine) to improve the solvent resistance of the cured coating.

In Japanese Patent No. 7630246, it is disclosed that adhesion of the freshly formed or wet coating to the underlying metallic substrate can be improved by contacting the coating with an acidic aqueous solution of an inorganic or organic acid or of an oxidizing agent (for example, sodium permanganate). This in turn leads to the provision of cured coatings which have a more uniform and appealing appearance. In addition to the use of chromium compounds, aforementioned U.S. Pat. No. 3,647,567 teaches the use of an aqueous solution of phosphoric acid to improve the corrosion resistance of the resinous coating described therein.

In addition, Japanese Patent No. 7630245 discloses the treatment of an uncured autodeposited coating with an aqueous composition containing a water-miscible coalescing agent comprising a compound having two or more oxygen-containing functional groups such as ester groups, hydroxy groups, carbonyl groups and ether linkages. Examples of such classes of compounds include alcohols, ketones, alcohol esters, ketone esters, ketone ethers, and ester ethers. This Japanese patent discloses that the treatment of uncured autodeposited coatings with such coalescing agents inhibits or deters the tendency of the cured form of the coating to blister, crack and/or bridge.

It is an object of this invention to provide metallic surfaces, particularly surfaces that are made of one of the types of high carbon steel conventionally used for heavy duty springs and/or ferriferous surfaces that have been cold worked, especially by shot peening, grit blasting, or the like before being coated, with autodeposited coatings with better adhesion and/or better corrosion resistance than those obtained by following the teachings of the prior art.

DESCRIPTION OF THE INVENTION

In this description, except in the specific examples or where expressly indicated to the contrary, all numbers specifying amounts of materials or conditions of reaction or use are to be understood as modified by the term "about" in determining the broadest scope of the invention. Practice of the invention within the exact numerical limits given is generally preferred.

SUMMARY OF THE INVENTION

In a major embodiment of the present invention, improvements in properties of cured autodeposited coatings are achieved by contacting the uncured form of the coatings with an alkaline aqueous solution that also contains a component selected from the group consisting of anions of organophosphonic acids, in an amount sufficient to improve the corrosion resistance, adherence, and/or both corrosion resistance and adherence of the autodeposited coating after curing it. An advantage of the present invention is that improvements in the properties of autodeposited coatings can be realized by the use of a treating solution which does not require the presence of hexavalent chromium or a similarly toxic material which creates waste disposal problems.

DESCRIPTION OF THE PREFERRED EMBODIMENTS

The general formula of a phosphonic acid is:

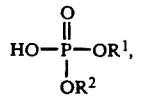

where $R^1$ is a monovalent covalently bonded moiety containing at least one carbon atom and optionally also containing other functional groups, and $R^2$ is either a hydrogen atom or a monovalent covalently bonded moiety containing at least one carbon atom and optionally also containing other functional groups, and may be the same as $R^1$ or different. Anions for use in this invention are preferably derived from phosphonic acids in which $R^2$ in the formula above is hydrogen. More preferably, the anions used in this invention are derived from acids having at least two ($H_2O_3P$) groups attached to a single carbon atom, e.g., from 1,1-diphosphonic acids having the general formula $(H_2O_3P)_2\text{-}CR^3R^4$, wherein each of $R^3$ and $R^4$ may be independently selected from hydrogen, hydroxyl, monovalent alkyl, monovalent substituted alkyl, and ($H_2O_3P$) groups. The most preferable anions are those of 1-hydroxyethylidene-1,1-diphosphonic acid, having the formula $C(OH)(CH_3)(PO_3H_2)_2$.

The pH of the solution used for treating an uncured autodeposited coating according to this invention is between 7 and 11, preferably between 7.5 and 10, more preferably between 8.2 and 9.0. The concentration of the stoichiometric equivalent as phosphonic acid is preferably between 0.05 and 5 percent by weight ("w/o"), more preferably between 0.2 and 2 w/o, most preferably between 0.5 and 1.5 w/o. In order to achieve the preferred pH values, the phosphonic acid may be neutralized with a base, preferably a fugitive base, and additional base may be added to achieve an alkaline pH. The most preferred base for use in preparing a treating solution according to this invention is ammonium hydroxide.

Higher phosphonic acid concentrations and higher pH values within the ranges given above are generally preferred for higher film thickness of the autodeposited coating to be treated according to the invention. Uncured film thickness treated are preferably from 12 to 50 micrometers ("$\mu$"), more preferably from 18 to 31 $\mu$.

Preferred coatings which are treated according to the process of the present invention are formed from an autodepositing composition in which particles of resin are dispersed in an aqueous acidic solution which is prepared by combining hydrofluoric acid and a soluble ferric iron-containing ingredient, most preferable ferric fluoride.

U.S. Pat. Nos. 4,347,172 and 4,411,937 which disclose the preferred activating system disclose the optional use in the composition of an oxidizing agent in an amount to provide from about 0.01 to about 0.2 oxidizing equivalent per liter of composition. Suitable oxidizing agents are those commonly known as depolarizers. Examples of oxidizing agents are hydrogen peroxide, dichromate, permanganate, nitrate, persulfate, perborate, p-benzoquinone and p-nitrophenol. Hydrogen peroxide is preferred.

Preferred resins for use in forming autodeposited coatings which are treated according to the present invention comprise internally stabilized vinylidene chloride copolymers or externally stabilized vinylidene chloride copolymers containing in excess of 50 w/o, or more preferably at least 80 w/o, of vinylidene chloride. Most preferably, the vinylidene chloride copolymer is crystalline in nature. Exemplary crystalline resins are described in U.S. Pat. No. 3,922,451 and aforementioned U.S. Pat. No. 3,617,368. Generally speaking, crystalline vinylidene chloride-containing resins comprise a relatively high proportion of vinylidene chloride, for example, at least about 80 wt. % thereof. However, any resin suitable for use in an autodepositing composition can be used.

Internally stabilized polymers or resins include as part of their chemical structure a surfactant group which functions to maintain polymer particles or resin solids in a dispersed state in an aqueous medium, this being the function also performed by an "external surfactant", that is, by a material which has surface-active properties and which is absorbed on the surface of resin solids, such as those in colloidal dispersion. As is known, the presence of an external surfactant tends to increase the water sensitivity of coatings formed from aqueous resin dispersions containing the same and to adversely affect desired properties of the coatings. The presence of undue amounts of surfactant in autodepositing compositions can lead to problems, as described in U.S. Pat. No. 4,191,676, the disclosure of which, to the extent not inconsistent with any explicit statement herein, is incorporated herein by reference, particularly as regards its description respecting surfactants and amounts thereof in autodepositing compositions. As discussed in this patent, the presence of an undue amount of surfactant in autodepositing compositions can deter the build-up of resin particles on the metallic surface being coated. In addition, the presence of undue amounts of surfactant can also adversely affect desired coating properties, for example, corrosion resistant properties. An advantage of internally stabilized vinylidene chloride-containing polymers is that stable aqueous dispersions, including acidic aqueous dispersions of the type comprising autodepositing compositions, can be prepared without utilizing external surfactants. (It is noted that there is a tendency in the literature to use interchangeably the following terms in connection with describing surface active materials which are used in polymerization processes for preparing polymers of the type to which the present invention relates: surfactant, wetting agent, emulsifier or emulsifying agent, and dispersing agent. As used herein, the term "surfactant" is intended to be synonymous with the aforementioned.) Various types of internally stabilized vinylidene chloride-containing polymers are known and species thereof are available commercially. Examples of such latexes are the Saran latexes such as, for example, SARAN TM 143 and SARAN TM 112 available from W. R. Grace Co. and the SERFENE TM latexes available from Morton Chemical. In accordance with the present invention, these commercial latexes can be used to excellent advantage, and internally stabilized latexes in general are preferred.

Various surfactants which function to maintain polymeric particles in dispersed state in aqueous medium include organic compounds which contain ionizable groups in which the anionic group is bound to the principal organic moiety of the compound, with the cationic group being a constituent such as, for example, hydrogen, an alkali metal, and ammonium. Speaking generally, exemplary anionic groups of widely used surfactants contain sulfur or phosphorous, for example, in the form of sulfates, thiosulfates, sulfonates, sulfinates, sulfaminates, phosphates, pyrophosphates and phosphonates. Such surfactants comprise inorganic ionizable groups linked to an organic moiety.

Although various ways may be used to introduce into the molecular structure of the vinylidene chloride resin such ionizable groups, it is believed that the most widely used method for preparing such resins will involve reacting vinylidene chloride with a monomeric surfactant and optionally one or more other monomers. In such reaction, the monomeric surfactant comprises a material which is polymerizable with monomeric vinylidene chloride or with a monomeric material which is polymerizable with monomeric vinylidene chloride and which is ionizable in the reaction mixture and in the acidic aqueous medium comprising an autodepositing composition.

With respect to particular resins that can be used in the coating composition of the present invention, a preferred class can be prepared by copolymerizing (A) vinylidene chloride monomer with (B) monomers such as methacrylic acid, methyl methacrylate, acrylonitrile, and vinyl chloride and (C) a water soluble ionic material such as sodium sulfoethyl methacrylate. Although the constituents comprising the above-desired resin can vary over a relatively wide range, in general the resin will comprise the polymerized constituents in the following amounts:

1) between 45 and about 99 weight percent based on the total weight of monomers used of vinylidene chloride monomer;
2) from about 0.5 to 30 weight percent based on the total weight of (1) and (2) of a second relatively more hydrophilic ethylenically unsaturated monomeric material wherein such monomeric material has a solubility in both the water phase and the oil phase of the polymer latex of at least 1 weight percent at the temperature of polymerization; and
3) from about 0.1 to about 5 weight percent based on the total weight of other monomers of an ionic, significantly water-soluble material which is copolymerizable with (2) and is selected from the group of sulfonic acids and their salts having the formula:

$$R\text{-}Z\text{-}Q\text{-}(SO_3)^-M^+,$$

wherein the radical "R" is selected from the group consisting of vinyl and substituted vinyl, for example, alkyl-substituted vinyl; the symbol "Z" represents a difunctional linking group which will activate the double bond in the vinyl group; -Q- is a divalent hydrocarbon having its valence bonds on different carbon atoms; and the symbol "M+38 represents a cation.

Examples of resins prepared from such monomers are disclosed in U.S. Pat. No. 3,617,368.

The relatively hydrophilic monomers of (2) above include those materials which are readily copolymerizable with (1) in aqueous dispersion, that is, which copolymerize within a period of about 40 hours at a temperature ranging from the freezing point of the monomeric serum up to about 100°C., and which have a solubility in both the water and the oil phase of the polymer latex of at least 1 weight percent at the temperature of polymerization. Exemplary of preferred materials, particularly when used in conjunction with monomeric vinylidene chloride are methacrylic acid and methyl methacrylate. Other monomers which may be advantageously employed include the hydroxyethyl and propyl acrylates, hydroxyethylmethacrylate, ethyl hexylacrylate, acrylic acid, acrylonitrile, methacrylonitrile, acrylamide, and the lower alkyl and dialkylacrylamides, acrolein, methyl vinyl ketone, and vinyl acetate.

These monomers, which can be employed in amounts of from 0.5 to 30 weight percent, based on the total weight of the nonionic monomers used, provide for the necessary reactivity with the copolymerizable ionic material of (3) and also provide for the required water solubility of the interpolymer in water. Thus, such materials may be referred to as "go-between" monomers. It is to be understood that the optimum amount of such relatively hydrophilic monomers may vary somewhat within the prescribed range depending upon the amount of hydrophobic monomer used in preparing the resin, as well as upon the amount and type of the copolymerizable ionic monomer used.

The copolymerizable ionic monomers used in preparing the aforementioned type resins are those monomeric materials which contain in their structure both an ionizable group and a reactive double bond, are significantly soluble in water, are copolymerizable with the hydrophilic monomer constituent (2) and in which the substituent on the double bond is chemically stable under the conditions normally encountered in emulsion polymerization.

Examples of the aforementioned divalent hydrocarbon having its valence bonds on different carbon atoms include alkylene and arylene divalent hydrocarbon radicals. Although the alkylene ($CH_2$) group can contain up to about 20 carbon atoms, it preferably has 1 to about 8 carbon atoms.

The solubility of the defined copolymerizable ionic material as described herein is strongly influenced by the cation $M^+$. Exemplary cations are the free acids, alkali metal salts, ammonium and amine salts and sulfonium and quaternary ammonium salts. Preferred are the free acids, alkali metal salts, particularly sodium and potassium, and ammonium salts.

It is further noted that, with one of the ions above, and the usual choices for R and Z, the solubility of the monomer depends on Q. As indicated, this group can be either aliphatic or aromatic and its size will determine the hydrophilic/ hydrophobic balance in the molecule, that is, if Q is relatively small, the monomer is water soluble, but as Q becomes progressively larger, the surface activity of such monomer increases until it becomes a soap and ultimately a water insoluble wax. It is to be understood, however, that the limiting size of Q depends on R, Z, and $M^+$. As exemplary of the above, it has been found that sodium sulfoethyl methacrylate is a highly acceptable copolymerizable ionic material for use in the present invention.

Further, the selection of R and Z is governed by the reactivity needed, and the selection of Q is usually determined by the reaction used to attach the sulfonic acid to the base monomer (or vice versa).

Processes for preparing latexes containing resins of the aforementioned type are known, such latexes being commercially available and being referred to herein as "self-stabilizing latexes", that is, latexes, the polymeric particles of which contain in the polymer molecule functional groups that are effective in maintaining the polymeric particles dispersed in the aqueous phase of the latex. As mentioned above, such latexes do not require the presence of an external surfactant to maintain the particles in their dispersed state. Latexes of this type generally have a surface tension very close to that of water (about 72 dynes/cm). It has been observed that autodepositing compositions containing such latexes form coatings which build up at a relatively fast rate.

An exemplary method for preparing such latexes involves preparation of an aqueous dispersion by an essentially continuous, carefully controlled addition of the requisite polymerization constituents (including polymerization initiator systems, if desired) to the aqueous medium having the desired pH value, followed by the subsequent addition of the necessary polymerization initiator, to form a polymeric seed latex in order to aid in the control of particle size. When forming such polymeric seed latexes, very small amounts of conventional surfactants, such as alkali soaps or the like, may be incorporated in the aqueous medium to further aid in the attainment of particles of desired size. The addition of such surfactants, however, is not critical for the production of the highly stable, internally stabilized, aqueous colloidal dispersions of polymeric particles of the type described above. In any event, additions of surfactants are limited so that the total amount present in the aqueous phase of the final coating solution is less than the critical micelle concentration, as taught in U.S. Pat. No. 4,191,676. Following the formation of the polymeric seed latex, the remaining polymerization constituents are simultaneously and continuously added under carefully controlled conditions to the aqueous medium.

Highly stable polymer latexes for use in the present invention are characterized by the virtual absence of undesirable coagulum which often results when polymeric latexes are stabilized by conventional water soluble surfactants. Thus, such latexes combine the highly beneficial properties of optimum colloidal stability, reduced viscosities at relatively high polymer solids content, low foaming tendencies, and excellent product uniformity and reproducibility. Such highly stable latexes which are internally stabilized are disclosed, for example, in U.S. Pat. No. 3,617,368.

A preferred embodiment of this invention comprises the use of vinylidene chloride-containing latexes in which a water soluble ionic material such as, for example, sodium sulfoethyl methacrylate is copolymerized with the comonomers comprising the copolymer. Sodium sulfoethyl methacrylate is particularly effective for use with monomeric vinylidene chloride and the relatively hydrophilic monomers methyl methacrylate or methacrylic acid when used in the amounts and in the manner called for by the present invention.

Particularly preferred latexes for use in this invention are latexes with about 35 to about 60 weight % solids comprising a polymeric composition prepared by emulsion polymerization of vinylidene chloride with one or more comonomers selected from the group consisting of vinyl chloride, acrylic acid, a lower alkyl acrylate (such as methyl acrylate, ethyl acrylate, butyl acrylate), methacrylic acid, methyl methacrylate, acrylonitrile, methacrylonitrile, acrylamide, and methacrylamide and stabilized with sulfonic acid or sulfonic acid salt of the formula $R\text{-}Z\text{-}(CH_2)_n\text{-}(SO_3)^-M^+$, wherein R represents vinyl or lower alkyl-substituted vinyl; Z represents one of the difunctional groups:

$$-\overset{O}{\overset{\|}{C}}-,\ -\overset{O}{\overset{\|}{C}}-O-,\ -O-\overset{O}{\overset{\|}{C}}-,\ \text{or}\ -\overset{O}{\overset{\|}{C}}-N(T)-,$$

where T represents hydrogen or an alkyl group; n is an integer from 1 to 20 (preferably 1 to 6), and $M^+$ is hydrogen or an alkali metal cation, preferably sodium or potassium.

A subgroup of preferred polymers are those having at least about 50% by weight of vinylidene chloride, but less than about 70%, and about 5 to about 35% vinyl chloride, and about 5 to about 20% of a vinyl compound selected from the group consisting of acrylic acid, methyl acrylate, ethyl acrylate, butyl acrylate, methacrylic acid, methyl methacrylate, acrylonitrile, methacrylonitrile, acrylamide and methacrylamide, and combinations thereof, and about 1 to about 3% by weight of sulfoethyl methacrylate.

A particularly preferred group of latexes, however, are latexes containing about 30 to about 70 weight % of solids formed by emulsion polymerization of about 50 to about 99% vinylidene chloride based on total weight of polymer and about 0.1 to about 5% by weight of sulfoethyl methacrylate, with optionally other comonomers selected from the group consisting of vinyl chloride, acrylic and methacrylic monomers such as acrylonitriles, acrylamides, methacrylamides and mixtures thereof in amounts between about 5 and about 50% by weight, and substantially free of unpolymerized surfactant or protective colloid.

Among other preferred subclasses of resin for use in this invention are dispersions of copolymers of about 50 to about 90% by weight of butyl acrylate and about 1 to about 2% by weight of sulfoethyl methacrylate based on the total weight of polymer. Another preferred subclass of polymers are the latexes of vinylidene chloride-containing polymers internally stabilized with sulfoethyl methacrylate and free of surfactant, and including optionally vinyl chloride and one or more acrylic comonomers.

Another preferred vinylidene chloride-containing copolymer is one comprising about 15 to about 20 weight % vinyl chloride, about 2 to about 5 weight % butyl acrylate, about 3 to about 10 weight % acrylonitrile, about 1 to about 2 weight % sulfoethyl methacrylate. This particular copolymer will have less than 70% by weight vinylidene chloride copolymer based upon total weight of comonomers (including the sulfoethyl methacrylate) used in the emulsion polymerization.

The amount of the resin comprising the coating composition can vary over a wide range. The lower concentration limit of the resin particles in the composition is dictated by the amount of resin needed to provide sufficient material to form a resinous coating. The upper limit is dictated by the amount of resin particles which can be dispersed in the acidic aqueous composition. In general, the higher the amount of resin particles in the composition, the heavier the coating formed, other factors being the same. Although coating compositions can be formulated with a range of about 5 to about 550 g/l of resin solids, the amount of the resin solids will tend to vary depending on the other ingredients comprising the composition and also on the specific latex or resin used. For many applications, good results can be achieved utilizing about 50 to about 100 g/l of resin solids in the composition.

Optional ingredients can be added to the composition as desired. For example, it is believed that the present invention will be used most widely in applications where it is desired to apply pigmented coatings to the metallic substrate. For this purpose, suitable pigments can be included in the composition. Examples of pigments that can be used are carbon black, phthalocyanine blue, phthalocyanine green, quinacridone red, benzidene yellow, and titanium dioxide. The pigment should be added to the composition in an amount which imparts to the coating the desired color and/or the desired depth or degree of hue. It should be understood that the specific amount used will be governed by the specific pigment used and the color of coating desired. Excellent results have been achieved by using the aqueous dispersion in an amount such that the composition contains about 0.2 to about 3 g of furnace black/100 g of resin solids.

Many pigments are available in aqueous dispersions which may include surfactants or dispersing agents for maintaining the pigment particles in dispersed state. When utilizing such pigment dispersions, they should be selected so that the surfactant concentration in the aqueous phase of the composition is below the critical micelle concentration ("CMC"), preferably below the surfactant concentration which corresponds to the inflection point on a graph of surface tension versus the logarithm of surfactant concentration in the composition. Suitable pigmented compositions are illustrated in examples herein.

Colored coatings can be produced also by the use of dyes, examples of which include rhodamine derived dyes, methyl violet, safranine, anthraquinone derived dyes, nigrosine, and alizarin cyanine green. These are but a few examples of dyes that can be used.

Examples of other additives that may be used in the autodepositing composition are those generally known to be used in formulating paint compositions, for example, UV stabilizers, viscosity modifiers, etc.

If a surfactant is added to the composition, either as a component of the latex, or with a pigment dispersion, or with other ingredients or additives, the total amount of surfactant in the aqueous phase of the composition should be maintained below the CMC. Preferably, the aqueous phase of the composition contains little or no surfactant.

In case a surfactant is utilized, the preferred surfactants are the anionic surfactants. Examples of suitable anionic surfactants are the alkyl, alkyl/aryl or naphthalene sulfonates, for example, sodium dioctylsulfosuccinate and sodium dodecylbenzene sulfonate.

In preparing the autodepositing composition, the constituents thereof can be admixed in any suitable way, for example, as described in U.S. Pat. No. 4,191,676. In preparing a bath of pigmented coating composition for use on an industrial scale, it is preferred that the bath be prepared by admixing:

A) an aqueous concentrate comprising about 350 to about 550 g/l of resin particles, preferable the aforementioned vinylidene chloride-containing resin particles, and about 10 to about 550 g/l of pigment; and B) an aqueous concentrate prepared from about 0.4 to about 210 g/l of HF and a water soluble ferric-containing compound in an amount equivalent to about 1 to about 100 g/l of ferric iron.

The bath can be prepared by stirring water into concentrate (A) and thereafter admixing therewith the required amount of concentrate (B) with stirring to provide a homogenous composition.

Various steps of the overall coating process in which the present invention is used can be like those of the prior art, except as noted herein. For example, cleaning of the metallic surface prior to coating can be in accordance with the teachings of U.S. Pat. No. 4,191,676. With respect to contacting the metallic surface with the autodepositing composition, it is believed that, for most applications, desired coating thicknesses can be obtained by immersing the metallic surface in the composition for a period of time within the range of about 30 seconds or even less to about 3 minutes. Good results have been achieved utilizing a time of immersion of not more than about 90 to about 120 seconds with compositions containing about 5 to about 10 wt % of resin solids. However, it should be understood that longer or shorter periods of time can be used. Agitating the composition aids in maintaining it uniform and in improving the uniformity of the coatings formed. With other factors held constant, heating of the composition will result in heavier coatings. However, satisfactory results can be obtained by operating the coating process at ambient temperature, and this is generally preferred for convenience.

In a typical industrial process, the freshly applied coating is rinsed with water after the coated surface has been withdrawn from the composition and before significant drying of the wet coating takes place. Such water rinsing is effective in removing therefrom residuals, such as acid and other ingredients of the composition that adhere to the coated surface. If such residuals are allowed to remain on the coated surface, they may adversely affect the quality of the coating. Improvements in rendering the cured form of the coating more impermeable to water, as provided by the present invention, are not realized by simply water rinsing the freshly formed coating.

Exemplary means for applying an adhesion and corrosion resistance promoting solution to the freshly formed coating include spray, mist, and immersion, with the preferred means of applying such solution being immersion of the uncured coated surface in the solution for a period of time of about 5 seconds to about 5 minutes.

The most preferred substrate for treatment according to this invention is a conventional automobile leaf spring made of high carbon steel and shot blasted on only one side. Such shot blasting is believed to have at least a slight effect on the electrochemical activity of the steel, and the difference in such activity between the shot blasted and non shot blasted sides may have caused some of the difficulties noted in earlier attempts to use autodeposition for springs of this type.

The preferred activating system comprises a ferric-containing compound and hydrofluoric acid. Thus, a preferred autodepositing composition comprises a soluble ferric ion containing compound in an amount equivalent to about 0.025 to about 3.5 g/l ferric iron, most preferably about 0.3 to about 1.6 g/l of ferric iron, and hydrofluoric acid in an amount sufficient to impart to the composition a pH within the range of about 1.6 to about 5.0. Examples of the ferric-containing compounds are ferric nitrate, ferric chloride, ferric phosphate, ferric oxide, and ferric fluoride, the last mentioned being preferred.

It is preferable if the alkaline components of the ACRPS are volatile or "fugitive". Aqueous ammonium hydroxide and ammonium bicarbonate exemplify such fugitive bases, but the latter is less preferred, because when using it there is greater danger of blisters in the autodeposited coating after oven curing.

After treatment according to this invention, the coating should be cured. Fusion of the resinous coating renders it continuous, thereby improving its resistance to corrosion and its adherence to the underlying metallic surface.

The conditions under which the curing and/or fusion operation is carried out depend somewhat on the specific resin employed. In general, it is desirable to apply heat to fuse the resin, although some of the vinylidene chloride-containing resins described above can be cured at room temperature. Generally, the corrosion resistance, hardness and solvent resistance properties of coatings fused at elevated temperatures have been observed to be better than coatings which have been air dried. However, there are applications where air dried coatings can be used satisfactorily. The fusion of the coating should be carried out under temperature and time conditions which do not adversely affect the desired properties of the coating. Exemplary conditions used in fusing the vinylidene chloride-containing coatings are temperatures within the range of about 20° C. to 120° C. for periods of time within the range of about 10 to 30 minutes, depending on the mass of the coated part. Baking the coating for a period of time until the metallic surface has reached the temperature of the heated environment has been used effectively.

When baked in an oven, the coating reaches the proper "curing" or heating temperature for the full development of coating properties when the metal part reaches that temperature. For this reason, parts that are constructed of thicker steel require longer times to reach the required temperature. For massive parts, it may not be possible to reach the required temperature without deleteriously affecting the coating and causing it to degrade.

In some cases, it is possible to overcome this problem by resorting to infrared radiation curing. In this case, it is possible to cure the coating without simultaneously raising the temperature of the metal to the required temperature. However, infrared radiation curing is practicable only for simple geometric shapes, since the area to be cured must be exposed to the infrared. In using infrared radiation curing, all coated surfaces must be visible to the infrared source, that is, the entire coated surface must "see" the infrared.

The practice of this invention may be further appreciated from the following non-limiting examples and comparison examples.

EXAMPLES AND COMPARISON EXAMPLES

The substrates coated for these examples were panels of high carbon spring steel as used for conventional automobile leaf springs. One side only of each panel had been shot blasted in a manner typical for the treatment of conventional automobile leaf springs before coating treatment was begun. The process sequence used was:

1. Spray clean for 75 seconds ("sec") at 60° C. with a conventional aqueous alkaline cleaner having a free alkalinity of 6–15 milliliters ("ml") and a total alkalinity not more than 3 times the free alkalinity when a sample of 10 ml of the cleaner is titrated with 0.1 N HCl solution, using phenolphthalein indicator for free alkalinity and bromphenol blue indicator for total alkalinity.
2. Allow to drain for 60 sec.

3. Dip clean for 150 sec at 65.6° C. with a conventional aqueous alkaline cleaner having a free alkalinity of 2–13 milliliters ("ml") and a total alkalinity not more than 3 times the free alkalinity when a sample of 10 ml of the cleaner is titrated with 0.1 N HCl solution, using phenolphthalein indicator for free alkalinity and bromphenol blue indicator for total alkalinity.
4. Allow to drain for 60 sec.
13. Dip for 75 sec at ambient temperature into an adhesion and corrosion resistance promoting treatment ("ACRPS") according to the invention or prior art, as specifically noted below.
14. Allow to drain for 180 sec.
15. Dry and cure in an oven at 110° for 25 minutes.

ACRPS compositions and test results are shown in Table 1.

TABLE 1

| Ex. No. | ACRPS Conc.[1] | ACRPS pH | Adhesion Test[2] Results Initial S[5] | Initial N[6] | Final S[5] | Final N[6] | Salt Spray Test[3] Results S[5] | Salt Spray Test[3] Results N[6] | Scribe/Scab Test[4] Results |
|---|---|---|---|---|---|---|---|---|---|
| (Comparison) Examples with Uncured Coating Thickness 25–28μ | | | | | | | | | |
| C1 | [7] | | 5 | 10 | 12 | 38 | VF + 9 0–1 | VF9 0–1 | 0.9 |
| C2 | [8] | | 0 | 0 | 0 | 0 | N | VF + 9 R9.5 | 1.1 |
| 1 | 1.5 | 9.0 | 0 | 4 | 0 | 14 | N | N | 0.3 |
| 2 | 1.5 | 7.5 | 5 | 6 | 3 | 23 | N[9] | [10] | 0.9 |
| 3 | 1.0 | 9.0 | 2 | 7 | 13 | 37 | N[11] | 0–1 | 1.0 |
| 4 | 0.5 | 8.2 | 8 | 9 | 5 | 16 | N | 0–2 | 0.7 |
| (Comparison) Examples with Uncured Coating Thickness 18–21μ | | | | | | | | | |
| C3 | [12] | | 5 | 2 | 48 | 26 | VF9 | n.m. | n.m. |
| C4 | [13] | | 76 | 12 | 82 | 17 | N | n.m. | n.m. |
| 5 | 0.5 | 7.5 | 17 | 7 | 50 | 10 | N[14] | n.m. | n.m. |
| 6 | 0.5 | 8.0 | 2 | 3 | 12 | 12 | N | n.m. | n.m. |

Footnotes for Table 1
[1]For the examples according to the invention (with numbers not prefixed by "C"), the concentration is in w/o of 1,1-hydroxyethylidene-1,1-diphosphonic acid. For the comparison examples (with numbers prefixed by "C"), the nature of the ACRPS is described in individual footnotes.
[2]Tested according to ASTM DO870-87 (Water Soak).
[3]Tested according to ASTM B117-85.
[4]Tested according to Ford Motor Company "APG" test.
[5]Measured on the shot peened side.
[6]Measured on the non shot peened side.
[7]ACRPS was about 0.1N NaOH solution in water.
[8]ACRPS was about 4 w/o sodium dichromate solution in water.
[9]One of the three panels tested was 0–3 instead.
[10]Three panels ranged from 0–1 to 0–5.
[11]One of three panels tested blistered.
[12]ACRPS was about 0.1N NaOH solution in water.
[13]ACRPS was about 0.1N $NH_4HCO_3$ solution in water.
[14]One of the three panels tested was rated VF9 instead.
"Initial" Adhesion was measured after drying but without any water soak according to GM 9071P method. "Final" Adhesion was measured after soaking dried panels for 2 hours in water at 38° C. "n.m." means not measured. Values reported are for three or more panels for each test condition unless otherwise noted.

5. Rinse with a tap water mist at 7°–10° C. for 30 sec.
6. Allow to drain for 15 sec.
7. Rinse with a deionized water mist at ambient temperature for 17 sec.
8. Allow to drain for 135 sec.
9. Dip coat for 145 sec in an autodeposition bath containing 1.8 grams per liter ("g/L") of ferric fluoride, 5 g/L of AQUABLACK TM 255 carbon black pigment (commercially available from Borden Chemical Company), sufficient solids from SARAN TM 143 latex to yield 5.2 0.2 w/o of total solids in the bath, sufficient hydrogen peroxide to maintain an oxidation potential of 350±20 millivolts more oxidizing than a silver-saturated silver chloride reference electrode on a platinum measuring electrode immersed in the bath, and sufficient hydrofluoric acid to maintain a reading of 250±25 microamps on a LINEGUARD TM 101 Meter. (Note: For Comparison Example 2, a different autodeposition bath containing {styrene-acrylate} copolymer latex instead of poly{vinylidene chloride} was used in this step.)
10. Allow to drain for 135 sec.
11. Dip rinse in tap water at ambient temperature for 75 sec.
12. Allow to drain for 135 sec.

I claim:

1. A process for forming an autodeposited organic coating o the metallic parts of the surface of an object, said process comprising steps of contacting the metallic surface to be coated with a liquid autodepositing composition to produce an uncured intermediate coating thereon and subsequently drying said uncured intermediate coating to produce the final autodeposited organic coating, wherein the improvement comprises contacting the uncured intermediate coating, before drying it, with an aqueous adhesion and corrosion resistance promoting solution ("ACRPS") having a pH between about 7 and about 11 and comprising from about 0.5 to about 5 w/o of anions of 1,1-diphosphonic acids.

2. A process according to claim 1, wherein the ACRPS comprises from about 0.2 to about 2 w/o of anions derived from 1,1-diphosphonic acids.

3. A process according to claim 2, wherein the ACRPS comprises from about 0.2 to about 2 w/o of anions of 1-hydroxyethylidene-1,1-diphosphonic acid.

4. A process according to claim 3, wherein the ACRPS comprises from about 0.5 to about 1.5 w/o of anions of 1-hydroxyethylidene-1,1-diphosphonic acid and the autodeposition bath used consists essentially of about 1.8 g/L of ferric fluoride, 5 g/L of carbon black pigment, sufficient solids from a poly{vinylidene chloride} based latex to yield from about 5.0 to about 5.4 w/o of total solids in the bath, hydrogen peroxide in such an amount as to produce an oxidation potential of from about 330 to about 370 millivolts more oxidizing than a silver-saturated silver chloride reference electrode on a platinum measuring electrode immersed in the bath, and sufficient hydrofluoric acid to impart to the autodeposition bath a pH within the range from about 1.6 to about 5.0.

5. A process according to claim 4, wherein the ACRPS consists essentially of water, ammonia, ammonium ions, and anions of 1-hydroxyethylidene-1,1-diphosphonic acid.

6. A process according to claim 3, wherein the ACRPS consists essentially of water, ammonia, ammonium ions, and anions of 1-hydroxyethylidene-1,1-diphosphonic acid.

7. A process according to claim 2, wherein the ACRPS consists essentially of water, ammonia, ammonium ions, and anions of 1,1-diphosphonic acids, and optionally, bicarbonate and carbonate anions.

8. A process according to claim 1, wherein the ACRPS consists essentially of water, ammonia, ammonium ions, and anions of 1,1-diphosphonic acids, and optionally, bicarbonate and carbonate anions.

9. A process according to claim 8, wherein the metallic surface to be coated includes at least a portion which is a surface of high carbon spring steel or shot blasted carbon steel.

10. A process according to claim 7, wherein the metallic surface to be coated is the surface of a leaf spring suitable for use in a conventional automobile.

11. A process according to claim 6, wherein the metallic surface to be coated is the surface of a leaf spring suitable for use in a conventional automobile.

12. A process according to claim 5, wherein the metallic surface to be coated is the surface of a leaf spring suitable for use in a conventional automobile.

13. A process according to claim 4, wherein the metallic surface to be coated is the surface of a leaf spring suitable for use in a conventional automobile.

14. A process according to claim 3, wherein the metallic surface to be coated is the surface of a leaf spring suitable for use in a conventional automobile.

15. A process according to claim 2, wherein the metallic surface to be coated includes at least a portion which is a surface of high carbon spring steel or shot blasted carbon steel.

16. A process according to claim 1, wherein the metallic surface to be coated includes at least a portion which is a surface of high carbon spring steel or shot blasted carbon steel.

* * * * *